US007398573B2

(12) United States Patent
Ellis et al.

(10) Patent No.: US 7,398,573 B2
(45) **Date of Patent: *Jul. 15, 2008**

(54) MATTRESS ASSEMBLY

(75) Inventors: Craig D. Ellis, Charleston, SC (US); Kenith W. Chambers, Charleston, SC (US); Stephen E. Glover, Charleston, SC (US); Kerry J. Mensching, Mt. Pleasant, SC (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/534,765

(22) Filed: Sep. 25, 2006

(65) Prior Publication Data

US 2007/0017032 A1 Jan. 25, 2007

Related U.S. Application Data

(60) Continuation of application No. 10/890,357, filed on Jul. 13, 2004, now Pat. No. 7,111,348, which is a continuation of application No. 10/254,343, filed on Sep. 25, 2002, now Pat. No. 6,760,939, which is a division of application No. 09/946,886, filed on Sep. 5, 2001, now Pat. No. 6,467,113, which is a continuation of application No. 09/465,872, filed on Dec. 16, 1999, now Pat. No. 6,295,675, which is a division of application No. 08/917,145, filed on Aug. 25, 1997, now Pat. No. 6,021,533.

(51) Int. Cl.

| | |
|---|---|
| ***A47C 27/10*** | (2006.01) |
| ***A61G 7/02*** | (2006.01) |
| ***A61G 7/00*** | (2006.01) |

(52) U.S. Cl. ..... 5/713; 5/710

(58) Field of Classification Search ..... 5/710, 5/713, 600, 655.3, 706, 185
See application file for complete search history.

(56) References Cited

U.S. PATENT DOCUMENTS

| | | | |
|---|---|---|---|
| 779,576 | A | 1/1905 | Berryman |
| 1,576,211 | A | 3/1926 | O'Kane |
| 2,253,801 | A | 8/1941 | Neal |
| 3,303,518 | A | 2/1967 | Ingram |
| 3,772,717 | A | 11/1973 | Yuen et al. |
| 3,978,530 | A | 9/1976 | Amarantos |
| 4,477,935 | A | 10/1984 | Griffin |
| 4,483,029 | A | 11/1984 | Paul |
| 4,525,885 | A | 7/1985 | Hunt et al. |
| 4,527,298 | A | 7/1985 | Moulton |
| 4,541,135 | A | 9/1985 | Karpov |

(Continued)

FOREIGN PATENT DOCUMENTS

| | | |
|---|---|---|
| GB | 159299 | 2/1921 |

(Continued)

OTHER PUBLICATIONS

Lumex Akro Tech 4000, Lumex, date unknown.

(Continued)

*Primary Examiner*—Alexander Grosz
(74) *Attorney, Agent, or Firm*—Kenneth C. Baran

(57) ABSTRACT

A mattress assembly is provided that includes an adjustable width.

29 Claims, 6 Drawing Sheets

U.S. PATENT DOCUMENTS

| | | | |
|---|---|---|---|
| 4,637,083 | A | 1/1987 | Goodwin |
| 4,638,519 | A | 1/1987 | Hess |
| 4,825,486 | A | 5/1989 | Kimura et al. |
| 4,944,060 | A | 7/1990 | Peery et al. |
| 4,951,335 | A | 8/1990 | Eady |
| 4,993,920 | A | 2/1991 | Harkleroad et al. |
| 5,020,176 | A | 6/1991 | Dotson |
| 5,029,352 | A | 7/1991 | Hargest et al. |
| 5,036,559 | A | 8/1991 | Hargest |
| 5,067,189 | A | 11/1991 | Weedling et al. |
| 5,083,332 | A | 1/1992 | Foster et al. |
| 5,121,512 | A | 6/1992 | Kaufmann |
| 5,168,589 | A | 12/1992 | Stroh et al. |
| 5,249,319 | A | 10/1993 | Higgs |
| 5,267,364 | A | 12/1993 | Volk |
| 5,325,551 | A | 7/1994 | Tappel et al. |
| 5,483,709 | A | 1/1996 | Foster et al. |
| 5,539,942 | A | 7/1996 | Melou |
| 5,542,136 | A | 8/1996 | Tappel |
| 5,561,873 | A | 10/1996 | Weedling |
| 5,564,142 | A | 10/1996 | Liu |
| 5,586,346 | A | 12/1996 | Stacy et al. |
| 5,611,096 | A | 3/1997 | Bartlett et al. |
| 5,623,736 | A | 4/1997 | Soltani et al. |
| 5,634,225 | A | 6/1997 | Miller, Sr. et al. |
| 5,699,570 | A | 12/1997 | Wilkinson et al. |
| 5,787,531 | A | 8/1998 | Pepe |
| 5,794,288 | A | 8/1998 | Soltani et al. |
| 5,815,865 | A | 10/1998 | Washburn et al. |
| 5,956,787 | A | 9/1999 | James et al. |
| 6,079,070 | A | 6/2000 | Flick |
| 6,295,675 | B1 | 10/2001 | Ellis et al. |
| 6,357,065 | B1 | 3/2002 | Adams |
| 7,028,358 | B2 | 4/2006 | Liu |
| 2004/0255386 | A1 | 12/2004 | Liu |

FOREIGN PATENT DOCUMENTS

| | | | |
|---|---|---|---|
| GB | 298817 | | 10/1928 |
| GB | 2 092 439 | A | 8/1982 |
| GB | 2 199 803 | A | 7/1988 |
| TW | 092116488 | | 3/2003 |
| WO | WO 94/09686 | | 5/1984 |
| WO | WO 95/31920 | | 11/1995 |
| WO | WO 96/33641 | | 10/1996 |

OTHER PUBLICATIONS

Gaymar Sof-Care Plus © Companion™ System, Gaymar Industries, Inc., 1994.

Air flow 5000 Mattress Replacement System, Atlantis Medical, Milltown, NJ, date unknown.

microAIR™ 1000, GSI Medical Systems, Carmel, NY, 1989.

Impression, Pressure Relief Therapy, KCI, date unknown.

First Step, Mattress Replacement System, KCI, San Antonio, TX, 1991.

PRO 2000 MRS, Pneu-Care Series, Cardio Systems, Dallas, TX, date unknown.

Bazooka, Innovative Medical System, Manchester, NH, 1995.

Economic Relief, Bio Therapy® Plus, Sunrise Medical Bio Clinic, Ontario, CA, date unknown.

Pxrenaissance™ , Therapeutic Mattress Replacement System, Pegausus Airwave Inc., date unknown.

Apropos, CRS-8500, National Patient Care Systems, date unknown.

ASAP II Therapy System, DynaMedics Corporation, Londoon, ON, Canada, Mar. 1995.

DFS® Homecare Advanced Dynamic Flotation System, HNE Healthcare, Manalapan, NJ, date unknown.

Pegausus Airwave Inc., date unknown.

MATTRESS ASSEMBLY

This application is a continuation application of U.S. application Ser. No. 10/890,357, filed Jul. 13, 2004, now U.S. Pat. No. 7,111,348, which is a continuation application of U.S. application Ser. No. 10/254,343, filed Sep. 25, 2002, now U.S. Pat. No. 6,760,939, which is a divisional application of U.S. application Ser. No. 09/946,886, filed on Sep. 5, 2001, now U.S. Pat. No. 6,467,113, which is a continuation application of U.S. application Ser. No. 09/465,872, filed on Dec. 16, 1999, now U.S. Pat. No. 6,295,675, which is a divisional application of U.S. application Ser. No. 08/917,145 filed on Aug. 25, 1997, now U.S. Pat. No. 6,021,533, the disclosures of which are expressly incorporated by reference herein.

This application is related to commonly owned, copending application 11/534,761.

BACKGROUND AND SUMMARY OF THE INVENTION

The present invention relates to a mattress assembly for use on a hospital bed. More particularly, the present invention relates to a mattress assembly having inflatable bladders.

According to present invention, a patient support apparatus is provided that is configured to support a patient on a patient support frame. The support apparatus includes a plurality of transversely extending bladders, a plurality of width adjustment bladders positioned between the plurality of transversely extending bladders and a perimeter of the support apparatus, and a valve. The width adjustment bladders have an inflated state and a deflated state. When in the inflated state, the support apparatus has a first width. When in the deflated state, the support apparatus has a second width less than the first width. The valve is configured to control the volume of air in the plurality of width adjustment bladders to regulate when the plurality of width adjustment bladders are in the inflated and deflated states.

According to another aspect of the present invention, a support apparatus is provided that is configured to support a patient on a patient support frame. The support apparatus includes a core portion, an inflatable width adjustment portion positioned between the core portion and a perimeter of the support apparatus, and an air supply. The perimeter has a first width when the width adjustment portion is inflated and a second width when the width adjustment portion is deflated. The second width is less than the first width. The core portion defines a majority of the width and maintains a patient in a preferred position above the bed frame when the inflatable width adjustment portion is inflated and deflated. The air supply is in fluid communication with the inflatable width adjustment portion.

According to another aspect of the present invention, a support apparatus is provided that is configured to support a patient on a patient support frame. The support apparatus includes a core portion and a width adjustment portion including a plurality of bladders positioned between the core portion and a perimeter of the support apparatus. The width adjustment portion has a wide condition and a narrow condition. The core portion and the width adjustment portion cooperate to define an adjustable width that is wider when the width adjustment portion is in the wider condition and narrower when the width adjustment portion is in the narrower condition. The core portion defines a majority of the adjustable width.

According to another aspect of the present invention, a support apparatus is provided that is configured to support a patient on a patient support frame. The support apparatus includes a central body support surface and a plurality of width adjustment bladders. Inflation of the plurality of width adjustment bladders increases the width of the support apparatus. Deflation of the plurality of width adjustment bladder decreases the width of the support apparatus. The plurality of width adjustment bladders are in fluid communication for simultaneous inflation or deflation of the width adjustment bladders.

According to another aspect of the present invention, a support apparatus is provided that is configured to support a patient on a patient support frame. The support apparatus includes a central body support surface, a plurality of width adjustment bladders, and a selector. Inflation of the plurality of width adjustment bladders increases the width of the support apparatus. Deflation of the plurality of width adjustment bladder decreases the width of the support apparatus. The width adjustment bladders are in fluid communication to coordinate the inflation or deflation of the width adjustment bladders. The selector is configured to coordinate inflation or deflation of the plurality of width adjustment bladders.

According to another aspect of the present invention, a support apparatus is provided that is configured to support a patient on a patient support frame. The support apparatus includes a cover defining an interior region, an inflatable central body support portion positioned in the interior region and configured to support the body of a patient, a pair of width adjustment portions, an air supply, a plurality of air lines, and a selector. The width adjustment portions are positioned on opposite sides of the inflatable central body support portion. Each of the width adjustment portions includes a plurality of width adjustment bladders coupled to the cover. Inflation of the plurality of width adjustment bladders increases the width of the support apparatus. Deflation of the plurality of width adjustment bladder decreases the width of the support apparatus while the inflatable central body support portion remains inflated. The width adjustment bladders are in fluid communication to coordinate the simultaneous inflation or deflation of the width adjustment bladders. The air supply is configured to provide pressurized air to the pair of width adjustment portions. The air lines are in fluid communication with the air supply and the plurality of width adjustment bladders. The selector is configured to coordinate inflation and deflation of the plurality of width adjustment bladders.

According to another aspect of the present invention, a method of providing a support surface for a patient is provided. The method includes a providing step and an adjusting step. The providing step includes providing a support apparatus having a support surface having a core and a width adjustment bladder. The width adjustment bladder is adjustable to permit selection of a width of the support apparatus defined by the width adjustment bladder and the core. The adjusting step includes adjusting the width of the support apparatus to correspond to a width of a bed frame configured to support the support apparatus.

Additional features of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
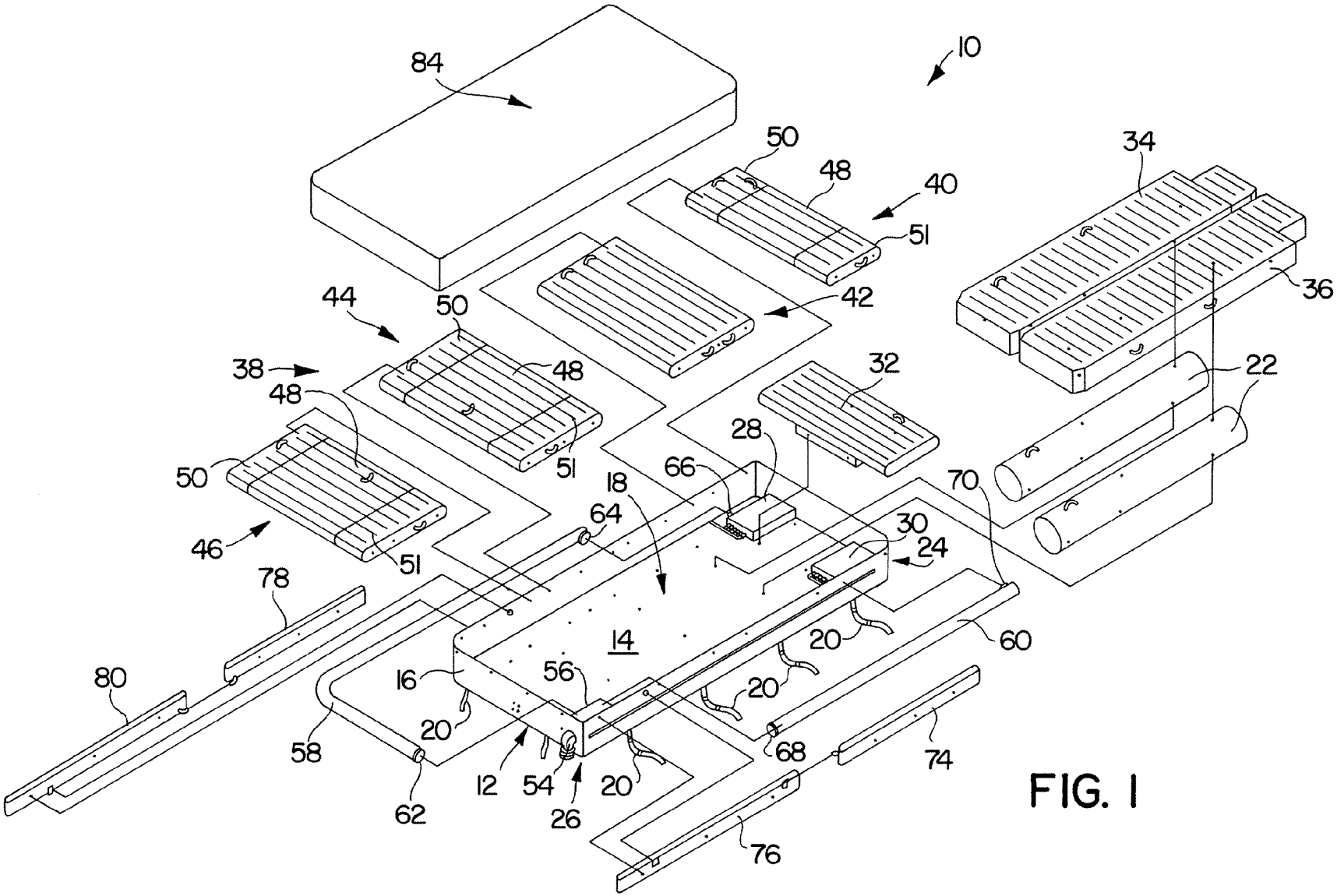
FIG. 1 is an exploded perspective view of the mattress assembly of the present disclosure illustrating a plurality of air cushions, air tubes, and control valves located between top and bottom covers.

Referring now to the drawings, FIG. 1 illustrates a mattress assembly 10 of the present disclosure. The mattress assembly 10 includes a bottom cover 12 having a bottom surface 14 and upwardly extending sidewall 16 surrounding bottom surface 14 to define an interior region 18. Straps 20 are coupled to bottom cover 12 for securing the mattress assembly 10 to a bed frame (not shown) if desired.

A plurality of air cushions are configured to be located within the interior region 18 of mattress assembly 10. A pair of rotation cushions 22 are located on bottom surface 14. Cushions 22 are stored in a normally deflated configuration on surface 14. Rotation cushions 22 are selectively inflated and deflated to control rotation therapy of a patient located on the mattress assembly 10.

The mattress assembly 10 includes a head end 24 and a foot end 26. A pair of proportional valve assemblies 28 and 30 are located in interior region 18 adjacent head end 24. A lower head cushion 32 is located within interior region 18 adjacent head end 24. Lower body cushions 34 and 36 are located in the interior region 18 spaced toward the foot end 26 from lower head bladder 32.

Transversely-extending support surface bladders 38 are located on top of bladders 32, 34, and 36 within a continuous interior volume of interior region 18. Support surface cushions 38 cooperate to define a core portion and include a head cushion 40, a chest cushion 42, a seat cushion 44, and a foot cushion 46. Support cushions 40, 44, and 46 include inner bladder sections 48 and outer bladder sections 50 and 51 which are separately controllable from an air supply source as discussed below.

Figure 2:
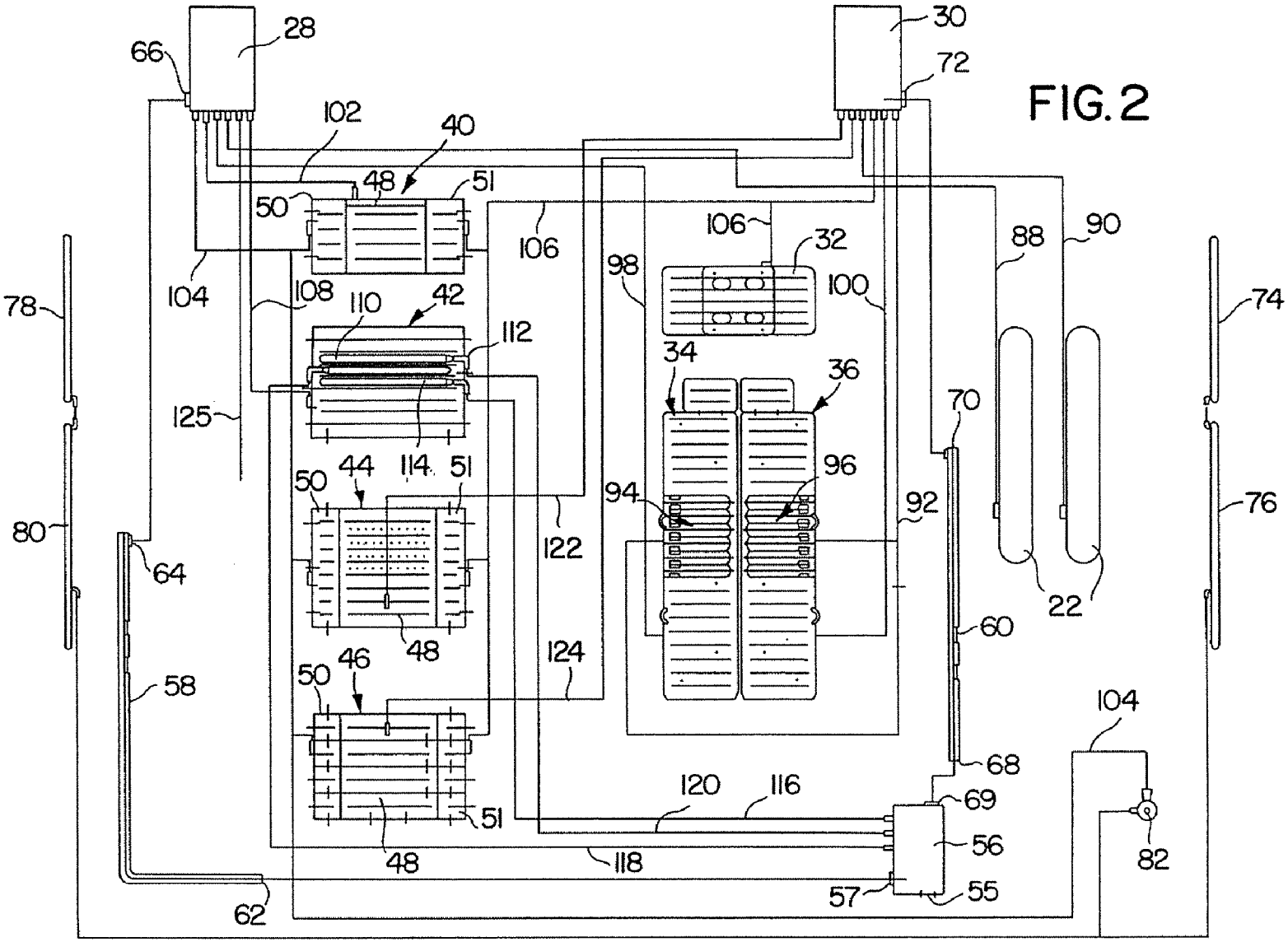
FIG. 2 is a diagrammatic view illustrating connection between the valves and the air cushions of the present disclosure.

Air enters the mattress assembly 10 from a blower or air supply 52 of an air system through inlet 54. Inlet 54 is coupled to an inlet 55 of a percussion/vibration valve 56. Air supply through inlet 54 is also coupled to valves 28 and 30 via flexible, cloth tubes 58 and 60, respectively. Cloth tube 58 includes a first end 62 coupled to an outlet 57 of the manifold of valve 56 and a second end 64 coupled to a manifold inlet 66 of valve 28. Cloth tube 60 has a first end 68 coupled to an outlet 69 of the manifold of valve 56 and a second end 70 coupled to a manifold inlet 72 of valve 30 as shown in FIG. 2. A mesh tube liner is located within and extends the length of each of the cloth tubes 58 and 60 to permit a vacuum to be applied to the tubes 58 and 60 to deflate the air bladders rapidly as discussed below.

The cloth tubes 58 and 60 are illustratively two-inch diameter tubes which transfer air from the blower unit 52 to the valve assemblies 28 and 30. Cloth tubes 58 and 60 are very flexible and reduce the likelihood of kinking when moved or articulated with the mattress assembly 10 compared to conventional plastic tubes.

The mattress assembly 10 further includes width adjustment bladders or extension cushions 74, 76, 78, and 80 which are positioned outside bottom cover 12. Cushions 74 and 78 are located on opposite sides of the mattress assembly 10 near head end 24. Cushions 76 and 80 are located on opposite sides of the mattress assembly 10 near foot end 26. As best illustrated in FIG. 2, the width extension cushions 74, 76, 78, and 80 are all coupled together and coupled to a valve or selector 82 of the air system located near foot end 26 of mattress assembly 10. Width extension cushions 74, 76, 78, and 80 cooperate to define width adjustment portions and are normally inflated during operation of the mattress assembly 10. When inflated, width extension cushions 74, 76, 78, and 80 cooperate with the other components to define a perimeter having a width greater than when the width extension cushions 74, 76, 78, and 80 are deflated. Valve 82 may be manually opened to release air from the width extension cushions 74, 76, 78, and 80 to permit the mattress assembly 10 to be moved to a narrower frame. In other words, when a wide frame is used, the width extension bladders 74, 76, 78, and 80 are inflated. Therefore, the mattress assembly 10 can be used to fit on frames having various widths without creating a gap between siderails of the frame and the edges of the mattress assembly 10. Typically, Med/Surg frames are wider frames. Critical care frames are typically narrower frames. Therefore, mattress assembly 10 can be used on both Med/Surg frames and critical care frames by manually opening and closing valve 82.

A top cover 84 is located all over the sidewall 16 of bottom cover 12. Top cover 84 defines a central body support surface and is illustratively a washable cover. The remainder of the cushions, hoses, and bottom cover are wipeable for cleaning.

FIG. 2 illustrates air flow between the valves and various cushions of the mattress assembly 10. Rotation bladders 22 are coupled to valves 28 and 30 by air supply lines 88 and 90, respectively. Lower head cushion 32 is coupled to line 106 from valve 30. Lower body cushions 34 and 36 include internal bladders 94 and 96, respectively, which are each coupled to a supply line 92 from valve 30. When operation of the mattress assembly is initiated, air is supplied through supply line 92 to inflate the internal bladders 94 and 96 automatically to a predetermined pressure to reduce the likelihood that a patient will bottom out against a bed frame. Internal bladders 94 and 96 are surrounded by external bladders of lower body cushions 34 and 36. The external bladders of cushions 34 and 36 are coupled to outlets of valves 28 and 30 by supply lines 98 and 100, respectively. Therefore, external bladders of cushions 34 and 36 can be controlled by lines 98 and 100 while the internal bladders 94 and 96 remain inflated by supply line 92.

Central section 48 of head support surface cushion 40 is coupled to an outlet of valve 28 by line 102. Opposite side sections 50 and 51 of head support surface cushion 40 are coupled to valves 28 and 30 by lines 104 and 106, respectively.

Chest support surface cushion 42 is coupled to valve 28 by line 108. Chest support surface cushion includes internal percussion/vibration (P/V) bladders 110, 112, and 114. P/V bladder 110 is coupled to a first outlet of P/V valve 56 by line 116. P/V bladder 112 is coupled to a second outlet of P/V valve 56 by line 118. P/V bladder 114 is coupled to a third outlet of P/V valve 56 by line 120.

Side portions 50 and 51 of seat support surface cushion 44 are coupled to lines 104 and 106 extending from valves 28 and 30, respectively. Central portion 48 of seat support surface cushion 44 is coupled to valve 30 by line 122.

Opposite side sections 50 and 51 of foot support surface cushion 46 are coupled to supply lines 104 and 106 of valves 28 and 30, respectively. Central section 48 of foot support surface cushion 46 is coupled to valve assembly 30 by supply line 124. Supply line 104 from valve 28 is also coupled to an inlet of valve 82. An outlet of valve 82 is coupled to width extension cushions 74, 76, 78, and 80 as discussed above. Outlet line 125 is a vent hose.

If it is desired to transport a bed with a patient on the mattress assembly 10, the valves 28 and 30 are actuated to deflate the inner sections 48 of cushions 40, 44, and 46 to a reduced pressure compared to outer sections 50 and 51. The outer sections 50 and 51 of cushions 40, 44, and 46 remain inflated. Cushions 34 and 35 remain inflated. This helps cradle the patient to maintain the patient on the mattress assembly 10 during transport of the bed.

Details of the valves 28, 30, and 56 are disclosed in U.S. application Ser. No. 09/093,303 which is based on U.S. Provisional Application No. 60/056,763, the disclosure of which is incorporated herein by reference.

Figure 3:
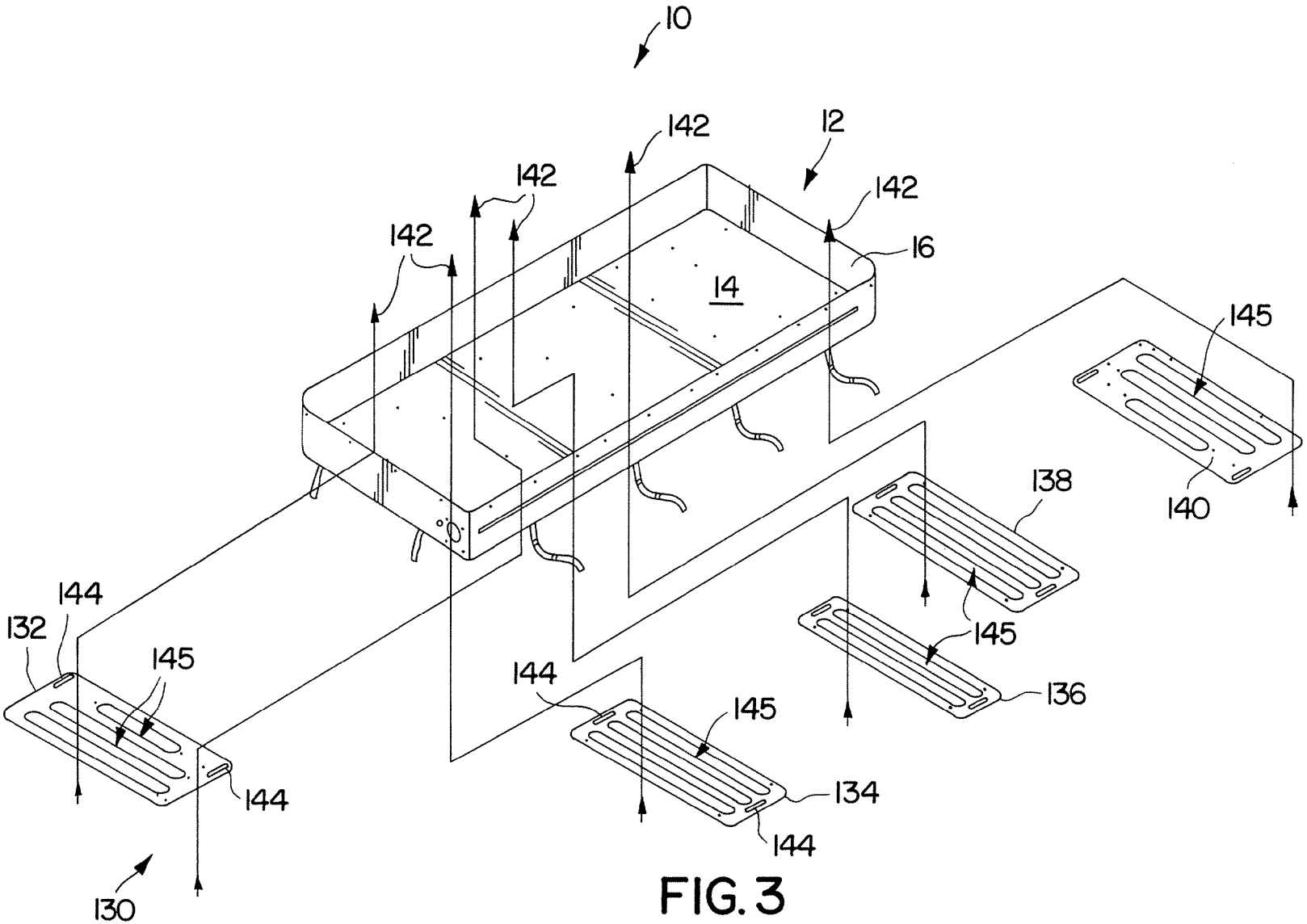
FIG. 3 is an exploded perspective view illustrating a bottom cover and a plurality of low friction plastic transfer plates configured to be coupled to the bottom cover to facilitate transfer of the mattress assembly from one bed frame to another.

FIG. 3 illustrates a plurality of transfer plates 130 which are coupled to bottom surface 14 of bottom cover 12 to facilitate transfer of the mattress assembly 10 from one bed frame to another bed frame. Transfer plates 130 include a foot plate 132, a thigh plate 134, a seat plate 136, a chest plate 138, and a head plate 140. Plates 132, 134, 136, 138, and 140 are each formed from a low friction plastic material. Plates are mounted to bottom surface 14 with suitable fasteners such as screws 142. It is understood that a plurality of fasteners 142 are used to couple each transfer plate 132, 134, 136, 138, and 140 to the bottom cover 10. It is also understood that other suitable fasteners such as rivets, snaps, etc. may be used for the plates 130. Each plate 132, 134, 136, 138, and 140 is formed to include a pair of apertures 144 which provide handle grips to facilitate transfer of the mattress assembly 10. Each plate 132, 134, 136, 138, and 140 is also formed to include a plurality of elongated apertures 145. The transfer plates 130 are used to reduce the friction while sliding the mattress assembly 10 from one bed frame to another to permit transfer without disrupting a patient lying on the mattress assembly 10.

Figure 4:
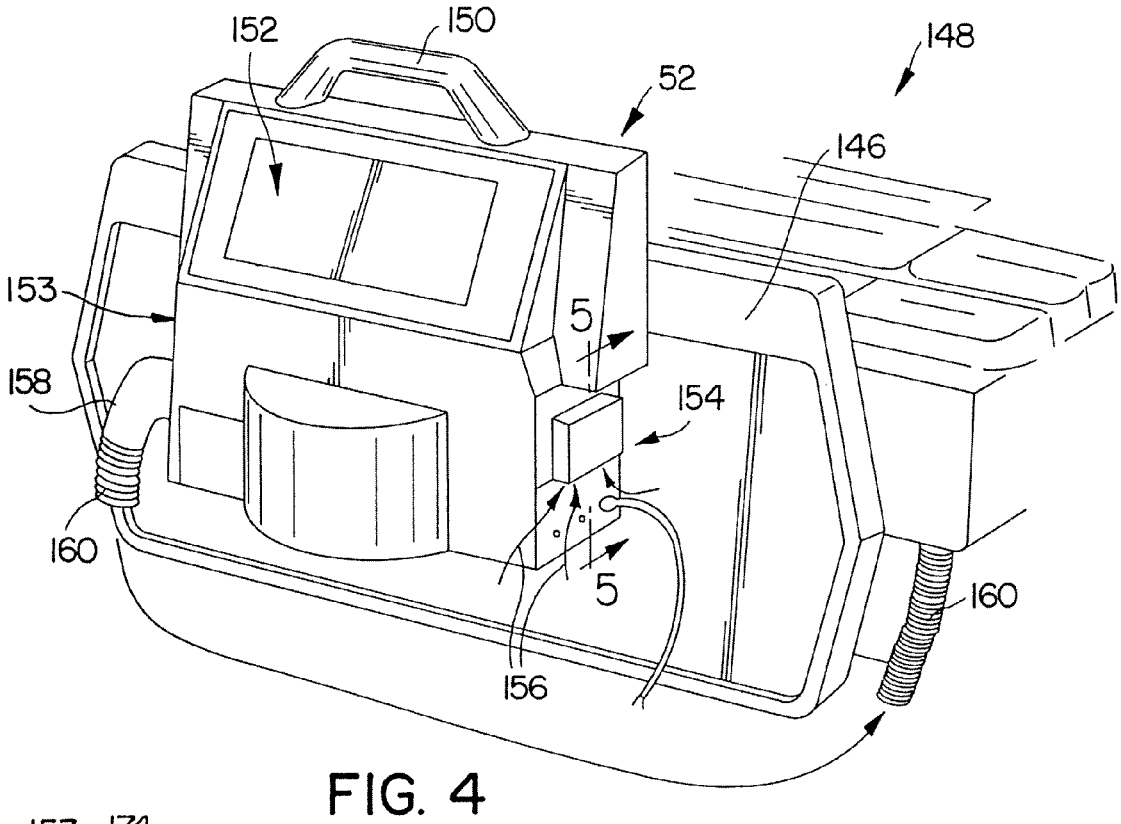
FIG. 4 is a perspective view illustrating a blower housing coupled to a foot board of a bed for supplying air to the mattress assembly.

Blower assembly 52 is configured to hang on to a foot board 146 of a bed 148 as shown in FIG. 4. The blower assembly 52 includes a handle 150, blower housing 153, and a touch screen control display 152. The touch screen control display or valve control 152 permits an operator to control operation of the blower assembly 52 and valves 28, 30, and 56 to control therapies of the mattress assembly 10. A main microprocessor of the assembly is included within the blower housing. In addition, a blower motor and a power supply are located within the blower housing.

Figure 6:
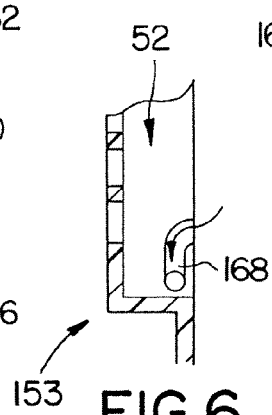
FIG. 6 is a partial sectional view illustrating a slot formed in the blower housing for receiving a corresponding pin formed on the air intake manifold.
Figure 7:
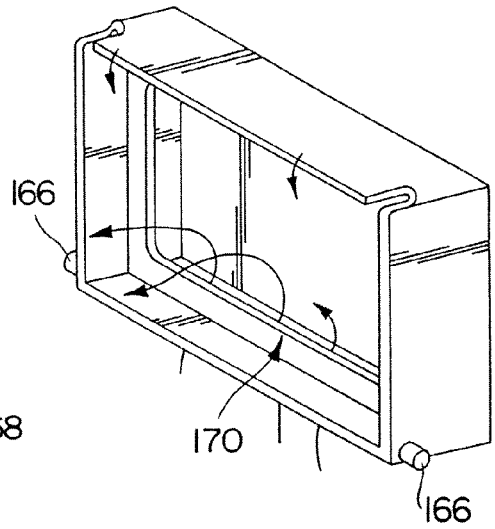
FIG. 7 is a perspective view illustrating further details of the air intake manifold.

Air enters the blower housing 153 through intake manifold 154 in the direction of arrows 156. Air exits blower assembly 52 through outlet connector 158 and passes through air hose 160 to the inlet of manifold of valve 56. Manifold 154 is configured to reduce air intake noise into blower assembly 52. Manifold 154 includes a rear wall 162 defining an inlet 164 along a bottom surface of manifold 154. Pegs 166 on opposite sides if manifold 154 are configured to couple the manifold 154 to the blower housing 153 by entering slots 168 as shown in FIG. 6.

Manifold 154 includes an internal lip 170 to retain a filter 172 in the manifold 154. In the illustrated embodiment, the blower housing 153 includes a recessed portion 174 for receiving the manifold 154. A grate 176 permits inlet air to pass into the blower housing 153 in the direction of arrows 178. The grate 176 is not required. In other words, an opening can be formed in blower housing 153 without the grate 176.

Figure 5:
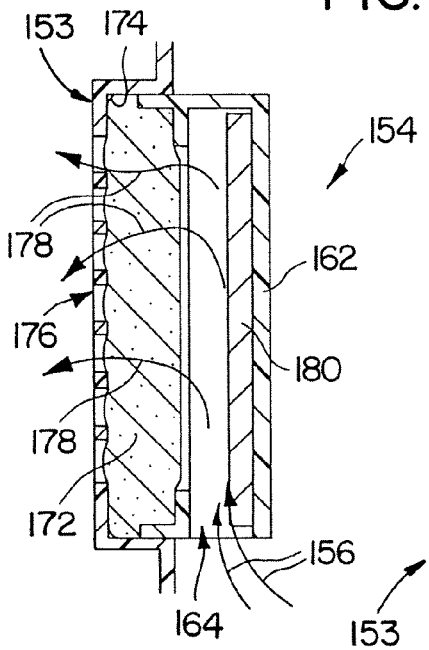
FIG. 5 is a sectional view taken along lines 5-5 of FIG. 4 illustrating an air intake manifold coupled to the blower housing.

As best illustrated in FIG. 5, manifold 154 deflects inlet air entering the blower housing 153 in the direction of arrows 156 by an angle of 90E. This directional change reduces air intake noise. A layer of sound foam 180 is located along rear wall 162 to further reduce air intake noise.

Figure 8:
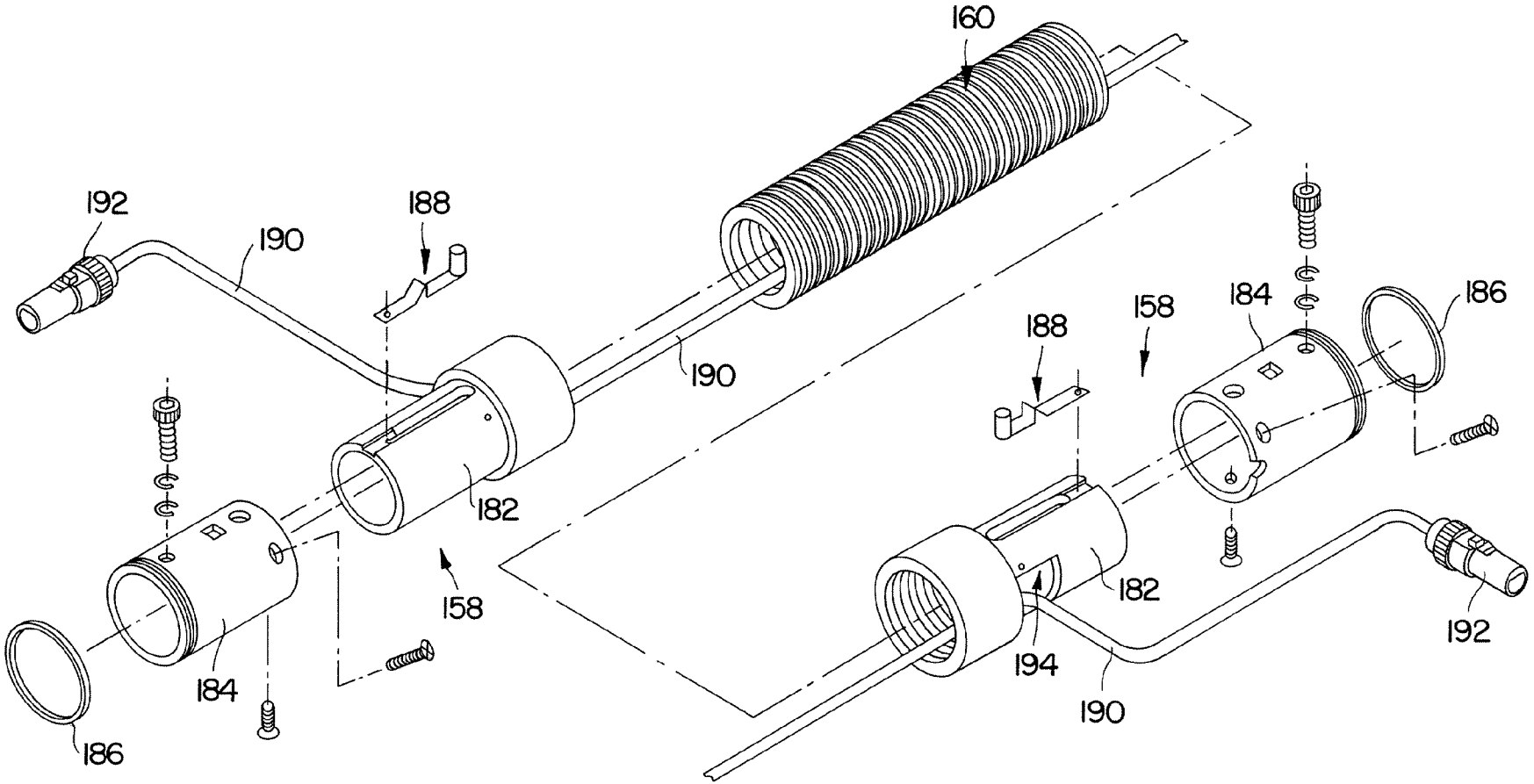
FIG. 8 is an exploded perspective view illustrating details of an air hose assembly extending between the blower housing and the mattress assembly which includes an internal electrical cord for transmitting control signals from the blower housing control panel to the mattress assembly.
Figure 9:
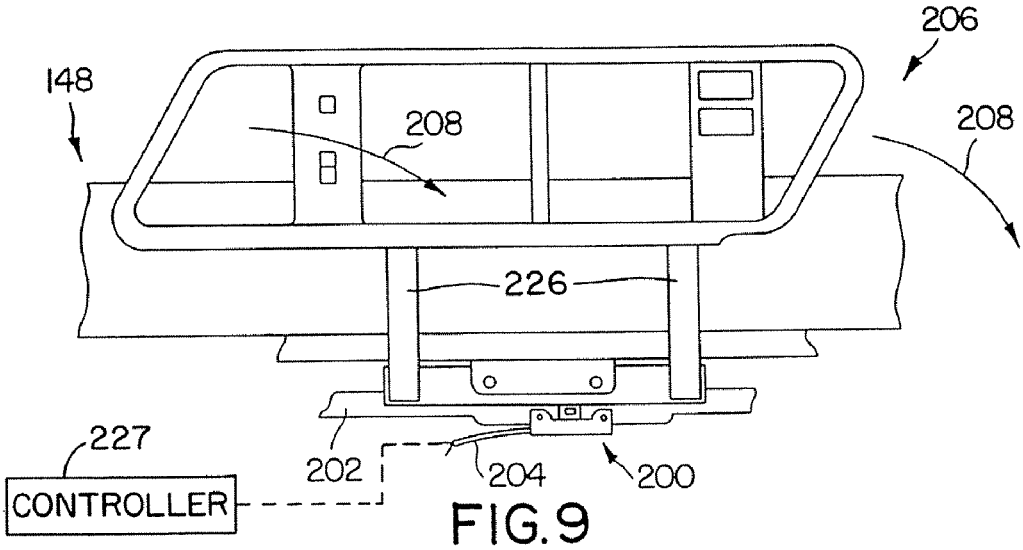
FIG. 9 is a partial side elevation view illustrating a siderail of a bed and a siderail down sensor coupled to a frame below the siderail.

Another feature of the present disclosure is illustrated in FIG. 8. The air supply hose 160 includes air connectors 158 at each end. Connectors include a hose fitting 182, an outer sleeve 184, and an O-ring 186. A spring release 188 is provided to lock the fittings 158 in place. An electrical cable 190 includes electrical connectors 192 at opposite ends. Cable 190 is inserted through openings 194 and fittings 182 so that the cable 190 extends through the air tube 160 from the blower housing 153 into the inside of mattress assembly 10. Therefore, cable 190 is not exposed. One connector 192 is coupled to the electrical circuit of the blower assembly 52 and the other connector 192 is coupled to the electrical circuit within the mattress assembly 10. When the fittings 182 and 184 are assembled, the fittings 182 and 184 clamp the cable 190 to provide strain relief for the cable 190.

If it is desired to quickly deflate the plurality of air cushions within the mattress assembly 10, the fitting 158 can be removed from an air outlet of the housing 153 and the manifold 154 can be removed from the air inlet of the blower housing 153. The fitting 158 coupled to air hose 160 is then connected to a female receptacle molded into the housing 153 at the air inlet so that air may be removed rapidly from the plurality of air cushions of the mattress assembly 10.

Another feature of the present disclosure is illustrated in FIGS. 9-13. A siderail down sensor 200 is provided coupled to a frame 202 of bed 148. The siderail down sensor 200 is configured to provide an output signal over signal line 204 when the siderail 206 of bed 148 is moved downwardly in the direction of arrows 208.

Figure 10:
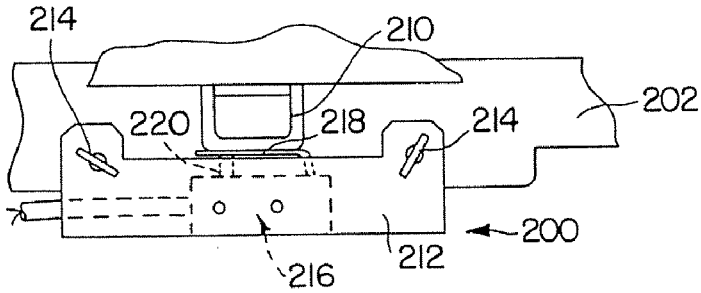
FIG. 10 is an enlarged side elevation view illustrating a switch of the siderail down sensor which is closed when the siderail is in its upwardly pivoted position.
Figure 11:
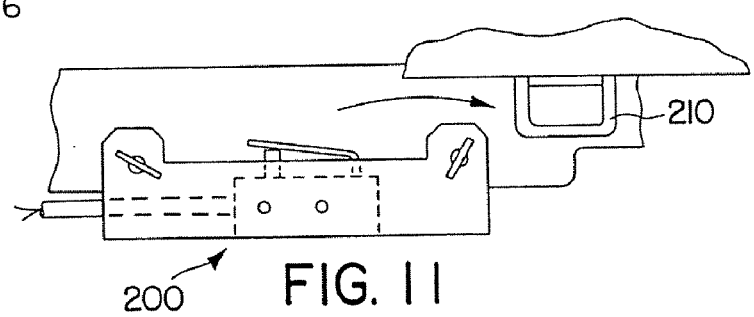
FIG. 11 is a side elevation view similar to FIG. 10 illustrating the sensor switch in an open position when the siderail is pivoted downwardly.

As illustrated in the enlarged views in FIGS. 10 and 11, the frame includes a support member 210 movable from the position over sensor apparatus 200 when the siderail is up to the position spaced apart from sensor apparatus 200 when the siderail is down. Sensor 200 includes a body 212 and fasteners 214 for securing the body 212 to the frame 202. Sensor 200 also includes a switch assembly 216 having an actuator arm 218 which closes and opens a switch 220 as the siderail 206 moves from its up position illustrated in FIG. 9 to the down position. In other words, when the switch 220 is open as shown in FIG. 11, an output signal is generated to indicate that the siderail 206 is down. When the controller 227 receives a siderail down signal from sensor 200, certain therapies of the mattress assembly 10 are disabled. For instance, rotational therapy is discontinued upon detection of the siderail being down by sensor 200.

Figure 12:
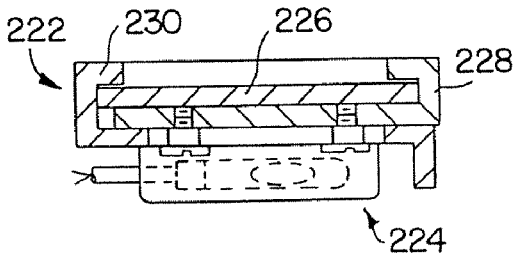
FIG. 12 is a sectional view taken through another embodiment of the siderail down indicator which clips on a frame member of the siderail.
Figure 13:
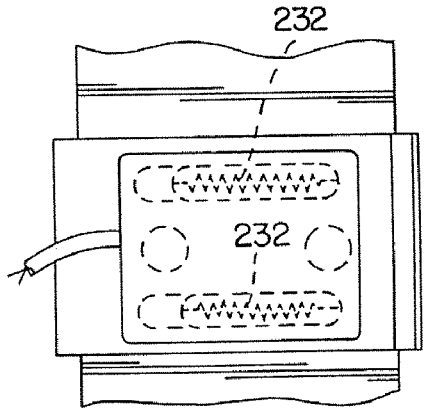
FIG. 13 is a side elevation view of the siderail down indicator of FIG. 12.

Another embodiment of the siderail down sensor is illustrated in FIGS. 12 and 13. In this embodiment, a clip assembly 222 is provided for securing the sensor 224 to the siderail 206. Specifically, the clip assembly 222 is configured to mount the sensor 224 to a support frame 226 of siderail 206. Clip assembly 222 includes a first body portion 228 slidably coupled to a second body portion 230. First and second body portions 228 and 230 are biased toward each other by springs 232. Illustratively, sensor 224 is a ball switch or a mercury switch.

Angle sensors are provided within the mattress assembly 10 so that the microprocessor can determine the articulation angle for a head section 24 of the mattress assembly 10. A first sensor such as an accelerometer is located in a seat section of the mattress assembly 10. A second sensor such as an accelerometer is coupled to a bottom surface of one of the valves 28 or 30 located within the head section 24 of the mattress assembly 10. The seat section accelerometer provides a reference output since the seat section does not articulate. Therefore, a zero reading can be taken from the seat sensor. As the head of the bed is articulated, the head sensor detects such movement and compares its new position to the reference position from the sensor in the seat section. The seat section sensor can accommodate movement to the Trendelenburg and reverse-Trendelenburg position so that the angle of the head section of the mattress relative to the seat section can always be detected during articulation of the mattress assembly 10 on a bed frame.

Although the invention has been described in detail with reference to a certain illustrated embodiment, variations and modifications exist within the scope and spirit of the present invention as described and defined in the following claims.

What is claimed is:

1. A support apparatus configured to support a patient on a patient support frame having a first width, the support apparatus comprising:

a core portion, including at least one air cushion; and a width adjustment portion including at least one bladder positioned between the core portion and a perimeter of the support apparatus, the width adjustment portion having a first condition and a second condition, the first condition adapted to support the patient on the patient support frame having the first width, the core portion and the width adjustment portion cooperating to define an adjustable width that is different than the first width when the width adjustment portion is in the second condition, the core portion having a width defining a majority of the adjustable width.

2. The support apparatus of claim 1, wherein the core portion comprises at least one of a head cushion, a seat cushion, and a foot cushion.

3. The support apparatus of claim 2, wherein the at least one bladder comprises an inflatable bladder.

4. The support apparatus of claim 2, wherein the width adjustment portion comprises a plurality of bladders.

5. The support apparatus of claim 4, wherein each of the plurality of bladders comprise an inflatable bladder.

6. The support apparatus of claim 2, wherein each of the head cushion, seat cushion, and foot cushion comprise an air cushion.

7. The support apparatus of claim 1, further comprising an air line, coupled to the at least one bladder.

8. The support apparatus of claim 7, wherein the air line does not extend through the core portion.

9. The support apparatus of claim 7, wherein the at least one cushion includes an interior portion free of the air line.

10. The support apparatus of claim 1, wherein the at least one bladder is substantially deflated in the first condition.

11. A method of providing a support surface for a patient, the method comprising:

providing a support apparatus including a support surface having a core portion, and at least one width adjustment bladder, the core portion including at least one air cushion having a first width, and the at least one width adjustment bladder having a second width less than the first width, the at least one width adjustment bladder being adjustable to permit selection of a width of the support apparatus defined by the at least one width adjustment bladder and the core, and adjusting the width of the support apparatus to correspond to a width of a bed frame configured to support the support apparatus, including deflating the width adjustment bladder while the core maintains normal support of the patient.

12. The method of claim 11, wherein the support apparatus includes a plurality of width adjustment bladders.

13. The method of claim 12, wherein the adjusting step comprises deflating the plurality of width adjustment bladders.

14. The method of claim 13, wherein the adjusting step comprises simultaneously deflating the plurality of width adjustment bladders.

15. The method of claim 14, further comprising the step of inflating the air cushion.

16. The method of claim 15, wherein the adjusting step further comprises inflating the at least one width adjustment bladder to adjust the width of the support apparatus.

17. The method of claim 16, wherein the inflating step comprises controlling inflation of the air cushion with a controller.

18. The method of claim 17, wherein the adjusting step comprises manually deflating the width adjustment bladder while the core maintains normal support of the patient.

19. A support apparatus configured to support a patient on a patient support frame having a first width, the support apparatus comprising:

a core portion;

a lower portion between the frame and the core portion; and a width adjustment portion including at least one bladder positioned between the core portion and a perimeter of the support apparatus, the width adjustment portion having a first condition and a second condition, the first condition adapted to support the patient on the patient support frame having the first width, the core portion and the width adjustment portion cooperating to define an adjustable width that is different than the first width when the width adjustment portion is in the second condition, the core portion having a width defining a majority of the adjustable width.

20. The support apparatus of claim 19, wherein the lower portion comprises a lower head cushion and laterally distributed lower body cushions.

21. The support apparatus of claim 19 comprising a pair of rotation bladders between the frame and the core portion.

22. The support apparatus of claim 21 wherein the core portion is between the lower portion and the rotation bladder.

23. The support apparatus of claim 22 wherein the lower portion comprises a lower head cushion and laterally distributed lower body cushions and the rotation bladder comprises a pair of laterally distributed rotation bladders.

24. A support apparatus, comprising:

a core portion;

a width adjustment portion;

first and second proportional valve assemblies;

the core portion being in fluid communication with both proportional valve assemblies and the width adjustment portion being in fluid communication with only one of the proportional valve assemblies.

25. The support apparatus of claim 24 including at least one of a lower portion and a rotation portion, the portion or portions being in communication with both proportional valve assemblies.

26. The support apparatus of claim 25 wherein the lower portion, if present, includes at least two lower cushions that are collectively in fluid communication with both of the proportional valve assemblies, and the rotation portion, if present, includes at least two rotation cushions the rotation cushions being individually in fluid communication with only one of the proportional valve assemblies and collectively in fluid communication with both of the proportional valve assemblies.

27. The support apparatus of claim 26 wherein the lower portion is present and includes at least two cushions each having an internal bladder and an external bladder and wherein the rotation portion is also present and includes at least two rotation bladders, and wherein the internal bladders are all in fluid communication with only one of the proportional valve assemblies and the external bladders are individually in fluid communication with only one of the proportional valve assemblies and collectively in fluid communication with both proportional valve assemblies.

28. The support apparatus of claim 24 wherein the core portion comprises at least two cushions, at least one of the cushions having a laterally inner section flanked by a left laterally outer section and a right laterally outer section;

a left fluid communication path extending from one of the proportional valve assemblies to all of the left laterally outer sections;

a right fluid communication path extending from one of the proportional valve assemblies to all of the right laterally outer sections;

the laterally inner sections of the cushions and any cushion not having the left, inner and right sections being individually in fluid communication with only one of the proportional valve assemblies and collectively in fluid communication with both of the proportional valve assemblies.

29. The support apparatus of claim 28 wherein at least one of the cushions does not include the left, inner and right sections and includes a percussion/vibration bladder, the percussion/vibration bladder being in fluid communication with a percussion/vibration valve.

* * * * *